US006269487B1

(12) United States Patent
Schryver et al.

(10) Patent No.: US 6,269,487 B1
(45) Date of Patent: Aug. 7, 2001

(54) TENNIS GLOVE

(75) Inventors: Barbara E. Schryver, 1546 13th Ave. N., Naples, FL (US) 34102; Susan C. Upham, Naples, FL (US)

(73) Assignee: Barbara E. Schryver, Naples, FL (US)

( * ) Notice: Subject to any disclaimer, the term of this patent is extended or adjusted under 35 U.S.C. 154(b) by 0 days.

(21) Appl. No.: 09/635,730

(22) Filed: Aug. 9, 2000

(51) Int. Cl.[7] ..... A41D 19/00
(52) U.S. Cl. ..... 2/161.1; 2/161.1; 2/162
(58) Field of Search ..... 2/159, 161.1, 161.2, 2/161.3, 161.4, 161.5, 161.6, 162, 164

(56) References Cited

U.S. PATENT DOCUMENTS 4,958,384 * 9/1990 McCrane ..... 2/162
5,517,694 * 5/1996 Fabry ..... 2/161.1
5,537,692 * 7/1996 Dorr ..... 2/161.1
5,575,008 * 11/1996 McBride et al. ..... 2/161.1
5,774,895 * 7/1998 Baldwin ..... 2/161.1

* cited by examiner

*Primary Examiner*—John J. Calvert
*Assistant Examiner*—Katherine Moran
(74) *Attorney, Agent, or Firm*—Allen D. Brufsky

(57) ABSTRACT

A glove is designed to not only increase the grip on a tennis racket, but one in which the wrist is maintained in relatively unflexed condition, so when the ball hits the racket, the return is straight and true. This is accomplished by providing a fabric palm and finger portion of the glove which is flexible and includes a roughened palm portion for increased gripping action and contact with the racket handle, but a relatively stiff wrist cover portion integral with the palm portion for precluding pivoting or flexure of the wrist.

9 Claims, 4 Drawing Sheets

TENNIS GLOVE

BACKGROUND OF THE INVENTION

1. Field of the Invention

This invention relates to the field of sports equipment, and more particularly, a glove specifically designed for use by a tennis player.

2. Description of the Prior Art

Gloves have been used to play various sports including golf and baseball. These gloves are primarily designed to improve the grip on a golf club or bat and to prevent the club or bat from slipping from the user's hands. Baseball gloves are also designed to absorb vibrations and therefore, are well padded in the palm area. However, there is no glove specifically designed for the tennis player, who requires completely different skills and disciplines. The present invention relates to such a glove.

SUMMARY OF THE INVENTION

In accordance with the present invention, a glove is designed to not only increase the grip on a tennis racket, but one in which the wrist is maintained in relatively unflexed condition, so when the ball hits the racket, the return is straight and true. This is accomplished by providing a fabric palm and finger portion of the glove which is flexible and includes a roughened palm portion for increased gripping action and contact with the racket handle, but a relatively stiff wrist cover portion integral with the palm portion for precluding pivoting or flexure of the wrist.

BRIEF DESCRIPTION OF THE DRAWING

Further objects and advantages of the invention will become more apparent from the following description and claims and from the accompanying drawings, wherein.

DETAILED DESCRIPTION OF THE PREFERRED EMBODIMENT

Figure 1:
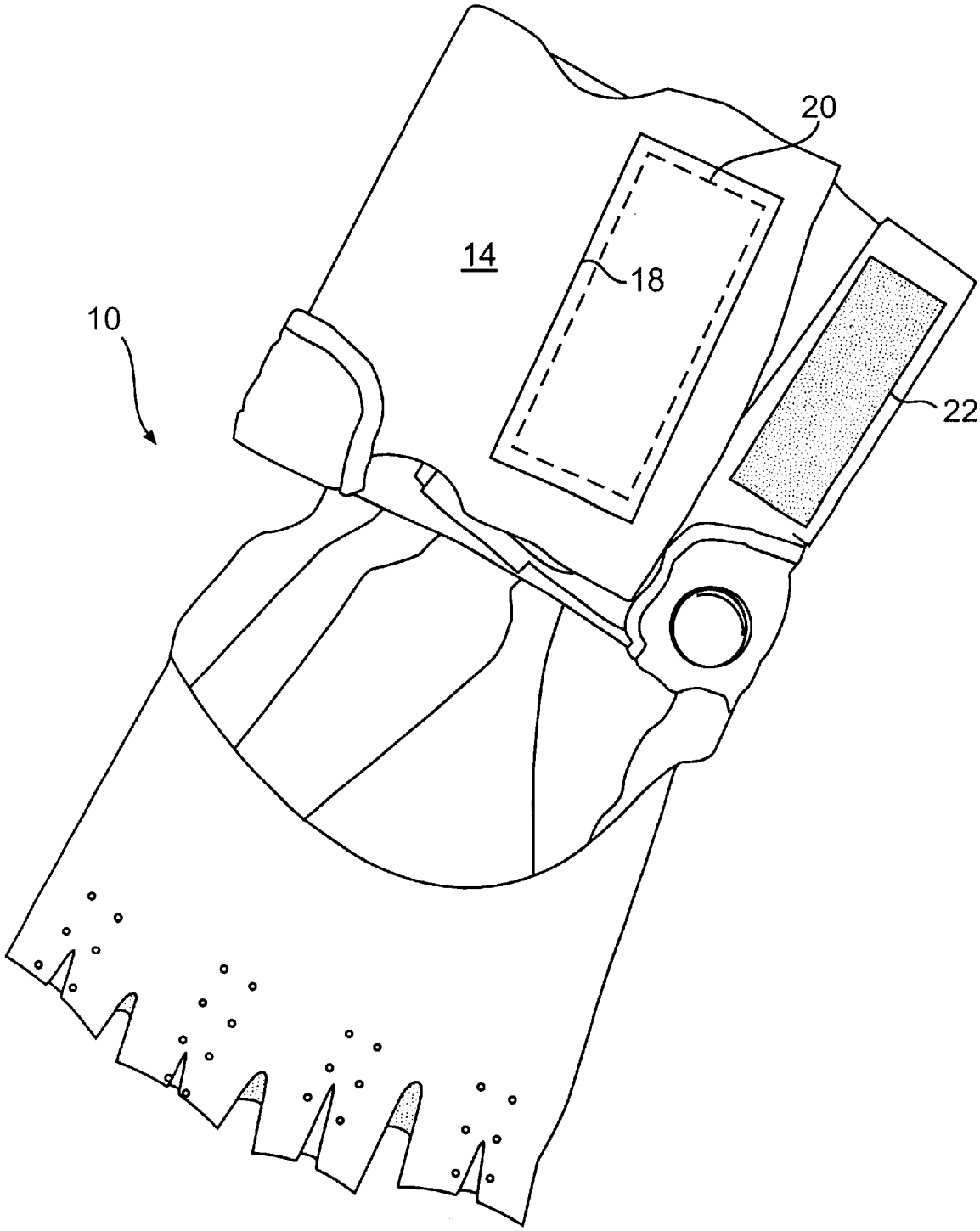
FIG. 1 is a perspective view of the front of the glove of the present invention.
Figure 2:
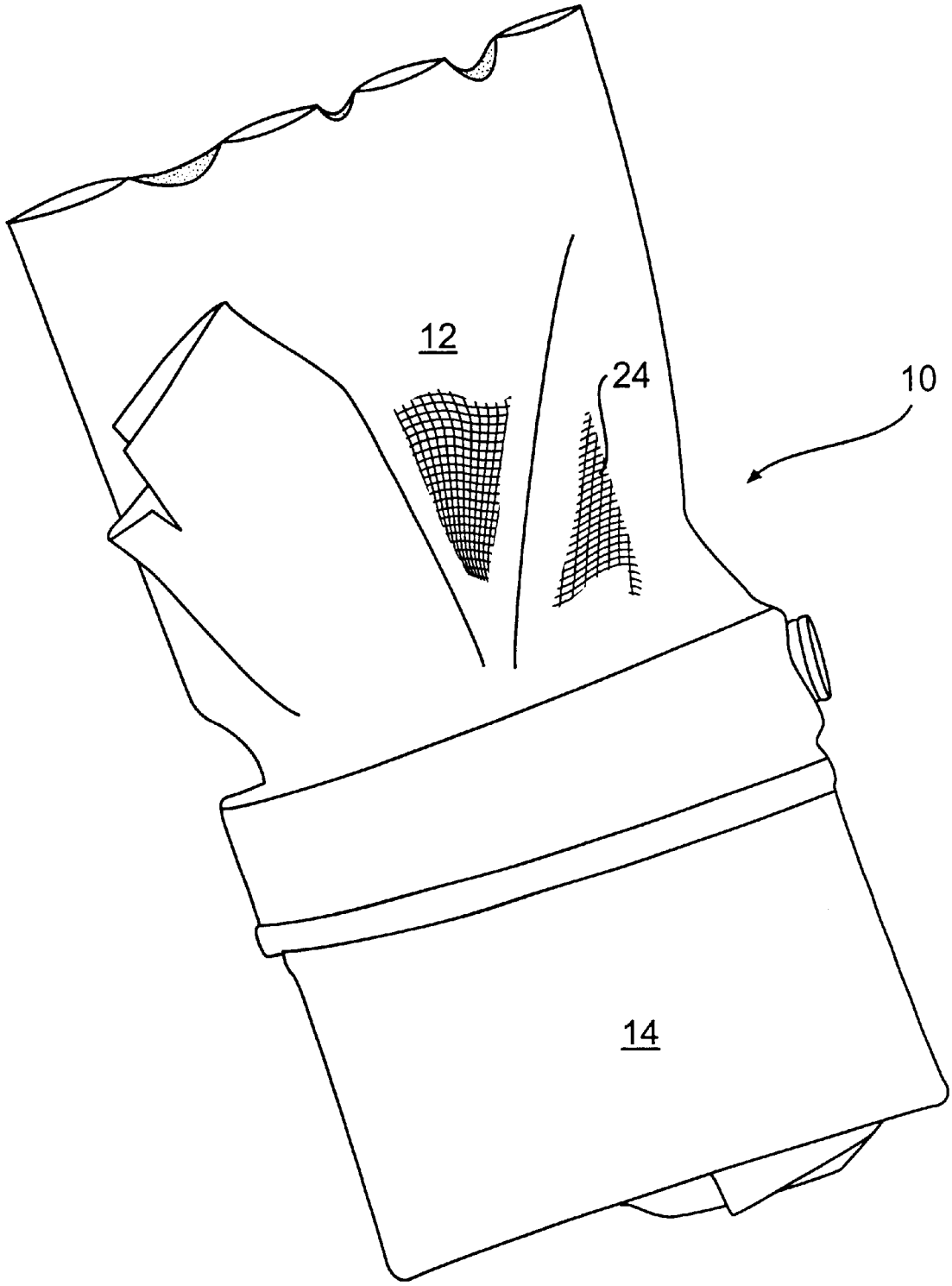
FIG. 2 is a perspective view of the rear of the glove of FIG. 1.
Figure 3:
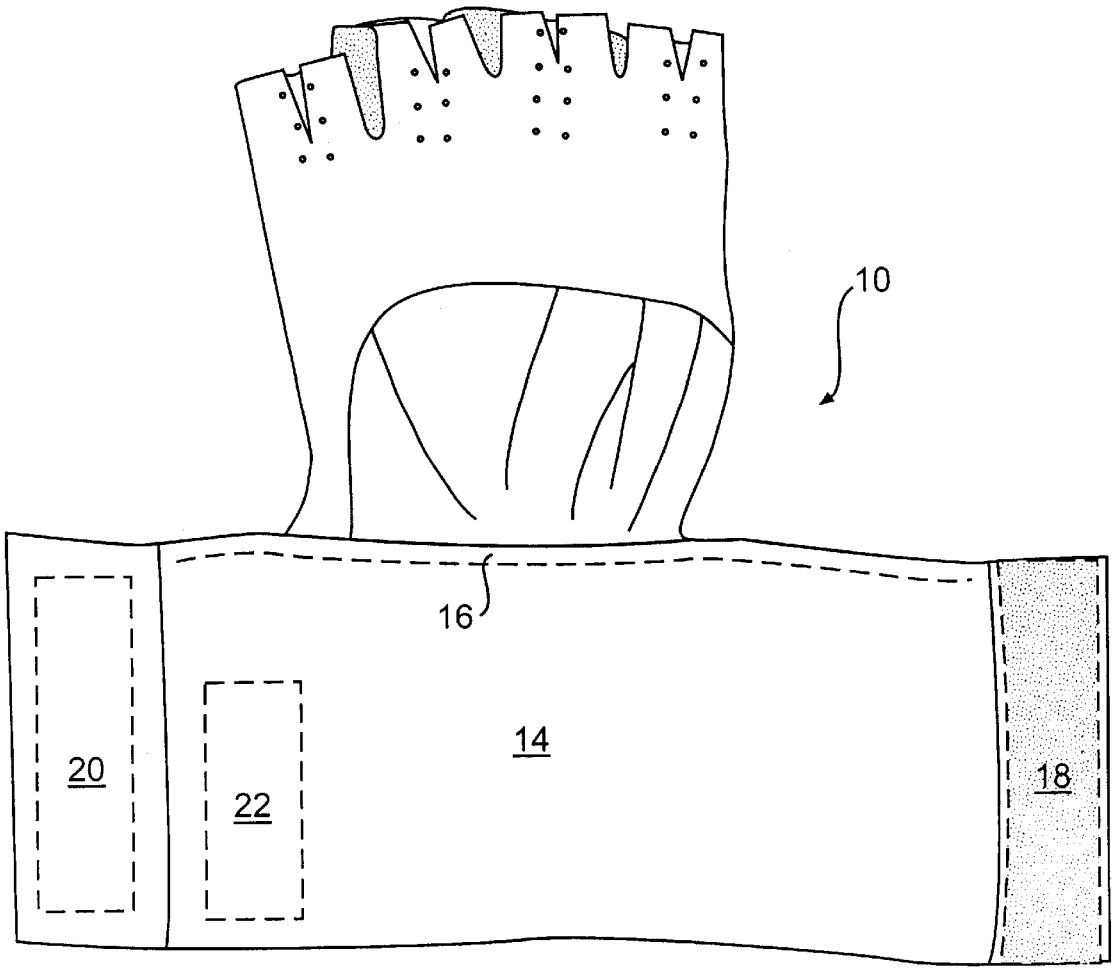
FIG. 3 is front plan view of the glove of FIG. 1, with a wristband portion opened to receive the hand of the hand and wrist of the user.
Figure 4:
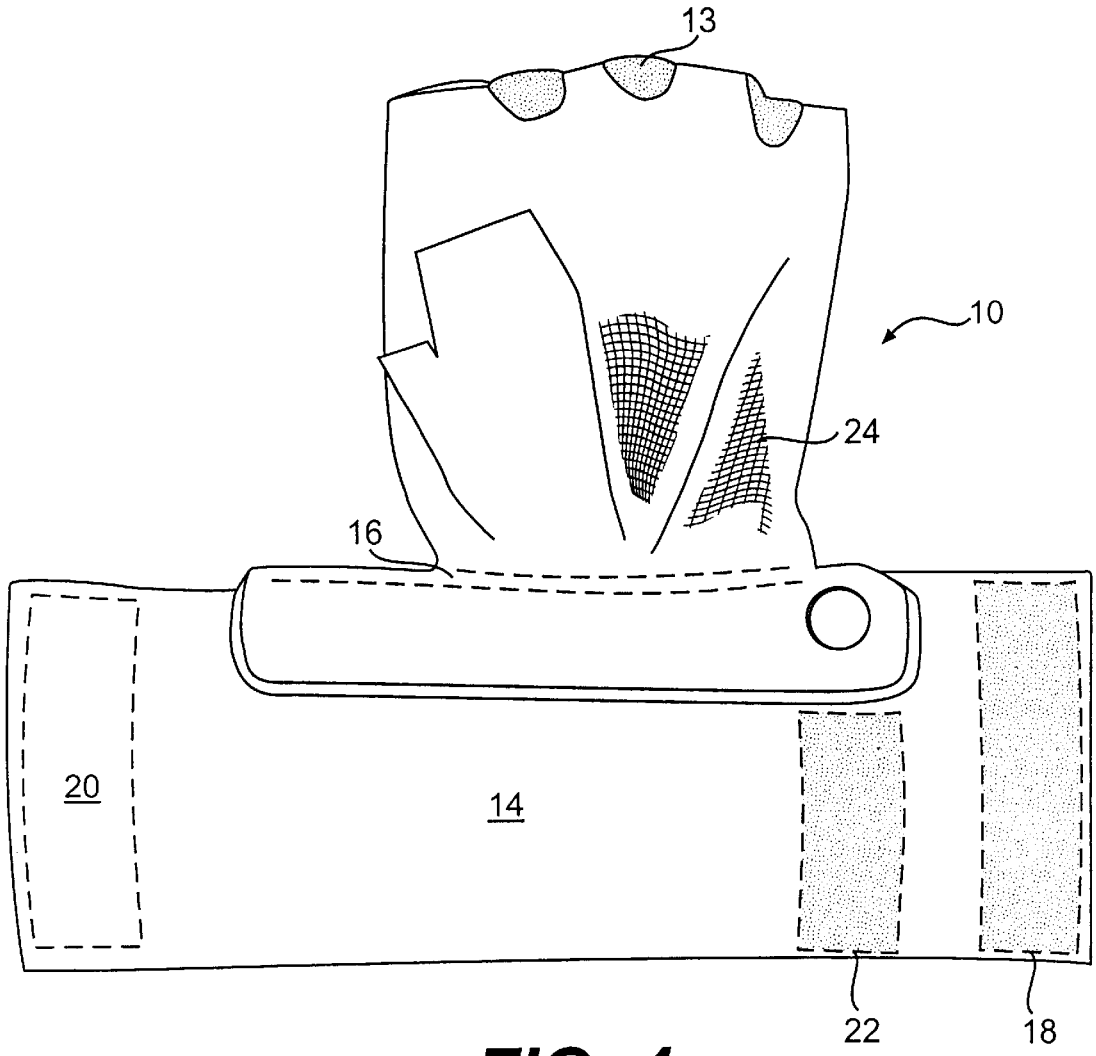
FIG. 4 is a rear plan view of the glove shown in FIG. 3.

Referring now to the drawings in detail, wherein like numerals indicate like elements throughout the several views, FIGS. 1 and 3 illustrate the front of the glove 10 and FIGS. 2 and 4 the rear of the glove 10 of the present invention.

The glove 10 includes a palm portion 12 terminating in finger receiving openings 13. A wristband portion 14 is sewn to palm portion 12 along a line 16 and includes Velcro mating strips 18, 20 for connecting the wristband portion 14 about the wrist of a wearer after insertion of the fingers through openings 12. A second Velcro "hook" portion 22 can be provided for contact with Velcro strip 20 to adjust then length of the wristband 14 in contact with the wrist for firm support and fit. Further, if the glove 10 is to be used in cold weather, finger-receiving portions can be provided contiguous with openings 13.

The front of the palm covering portion 12 is formed from soft or pliant cloth, latex or leather and has a plurality of ridges formed in a textured pattern for tactile and firm gripping of a tennis racket. The back of the palm portion 12 can be lined with water absorbent material for absorbing perspiration. Such a glove with these characteristics for use to grip a golf club is currently manufactured and sold by Dunlop Golf of Greenville, S.C. under the trademark Digitech, which disclosure is hereby incorporated by reference.

As shown in FIG. 1, the back of the palm portion 12 has material removed between the elastic wristband 14 to a position adjacent the finger receiving openings 13 to increase the relative flexibility between the wristband portion 14 and tennis racket gripping palm portion 12.

The wristband portion 14 is formed from relatively stiff, but porous, elastic, woven cloth material, so it can be pulled to cover the wrist, but will support and keep the wrist of the user stiff when the Velcro clasp 18, 20 is intact. The wrist of the wearer will thus be prevented from flexing upon striking of the ball with a tennis racket, resulting in a true and straight return.

We claim:

1. A sport glove especially useful in playing the game of tennis, comprising a palm portion having a front surface designed to grip the handle of a tennis racket, and a back surface joined along opposed lateral edges to said front surface, a relatively stiff, elastic wristband portion for encircling the wrist of a player only attached the bottom of the front surface of said palm portion to provide for flexure of the palm while supporting the wrist, and means for securing spaced portions of said wristband portion together about the wrist of the player.

2. The sport glove of claim 1 wherein said palm portion includes textured exterior surface ridges.

3. The sport glove of claim 1 wherein said palm portion includes a water absorbent interior surface.

4. The sport glove of claim 1 including finger receiving portions extending from said finger receiving openings.

5. The sport glove of claim 1 wherein said wristband portion is sewn to the bottom of said palm portion.

6. The sport glove of claim 1 wherein said securing means includes spaced mating hook and loop portions.

7. The sport glove of claim 6 including a second hook and loop fastener the length of the wristband in contact with the wrist of the player.

8. The sport glove of claim 1 wherein an opening is provided in a palm surface of said palm portion between the finger receiving openings and said elastic wristband portion to increase the relative flexibility between said palm and wristband portions.

9. The sport glove of claim 1 wherein said elastic wristband provides the only means of support for the wrist.

* * * * *